US005738544A

United States Patent [19]

Davis

[11] Patent Number: 5,738,544

[45] Date of Patent: Apr. 14, 1998

[54] SHIELDED ELECTRICAL CONNECTOR

[75] Inventor: Wayne Samuel Davis, Harrisburg, Pa.

[73] Assignee: The Whitaker Corporation, Wilmington, Del.

[21] Appl. No.: 673,224

[22] Filed: Jun. 27, 1996

[51] Int. Cl.[6] ..... H01R 13/648

[52] U.S. Cl. ..... 439/607; 439/610

[58] Field of Search ..... 439/607, 610, 439/676, 101, 108

[56] References Cited

U.S. PATENT DOCUMENTS

| | | | |
|---|---|---|---|
| 4,708,412 | 11/1987 | Himes, Jr. et al. | 439/95 |
| 4,842,554 | 6/1989 | Cosmos et al. | 439/609 |
| 4,842,555 | 6/1989 | Cosmos et al. | 439/609 |
| 4,938,704 | 7/1990 | Fujiura | 439/95 |
| 5,017,156 | 5/1991 | Sugiyama | 439/607 |
| 5,030,140 | 7/1991 | Sugiyama | 439/607 |
| 5,073,130 | 12/1991 | Nakamura | 439/607 |
| 5,083,945 | 1/1992 | Miskin et al. | 439/607 |
| 5,094,627 | 3/1992 | Uekido | 439/610 |
| 5,178,562 | 1/1993 | Ermini | 439/609 |
| 5,207,597 | 5/1993 | Kline et al. | 439/607 |
| 5,254,010 | 10/1993 | Davis | 439/609 |
| 5,266,038 | 11/1993 | Nakamura | 439/79 |
| 5,267,882 | 12/1993 | Davis | 439/680 |
| 5,378,172 | 1/1995 | Roberts | 439/607 |
| 5,409,400 | 4/1995 | Davis | 439/610 |
| 5,429,520 | 7/1995 | Morlion et al. | 439/108 |
| 5,496,195 | 3/1996 | Reed | 439/607 |
| 5,518,421 | 5/1996 | Davis | 439/607 |
| 5,637,015 | 6/1997 | Tan et al. | 439/607 |

OTHER PUBLICATIONS

U.S. Patent Application Serial No. 08/629,485 filed Apr. 10, 1996 (Abstract and Drawings only included).

U.S. Patent Application Serial No. 08/653,144 filed May 24, 1996 (Abstract and Drawings only included).

*Primary Examiner*—Hien Vu

*Attorney, Agent, or Firm*—Anton P. Ness

[57] ABSTRACT

Connector (10) includes a shell (14) having a forward end (18) adapted to engage the periphery of a panel cutout (92), by way of flanges (24) and a pair of tabs (26) engageable with a panel strip (96) separating two portions (94) of the cutout associated with separate plug connectors receivable into respective cavities (20,22) to be matable with connector (10) at the cutout.

4 Claims, 4 Drawing Sheets

SHIELDED ELECTRICAL CONNECTOR

FIELD OF THE INVENTION

This relates to the field of electrical connectors and more particularly to connectors having shields therearound.

BACKGROUND OF THE INVENTION

Electrical connectors are known that include shields therearound for protection against transmission and reception of electromagnetic interference. In U.S. patent application Ser. No. 08/629,485 filed Apr. 10, 1996 and assigned to the assignee hereof, a connector is disclosed having a shield member therearound and is mountable to a circuit board for placement at an input/output port of an electronic apparatus such as a computer. The input/output port is an aperture through a conductive panel member of the apparatus. Preferably the shield of the connector is in electrically engagement with the conductive panel to define a chassis ground, after mounting of the connector.

It is desired to provide enhanced shielding of the connector at the input/output port.

SUMMARY OF THE INVENTION

The present invention provides enhanced shielding of a connector at an input/output port, for a connector having a pair of plug-receiving cavities associated with respective plug connectors and matable therewith at the port. Two tabs extend toward each other from opposed sides of the shell forward end and are angled forwardly, and free ends thereof establish a ground connection with a strip of the panel dividing the cutout into two portions associated with plug connectors matable in separate cavities of the receptacle connector.

An embodiment of the present invention will now be described by way of example with reference to the accompanying drawings.

DETAILED DESCRIPTION

Figure 1:
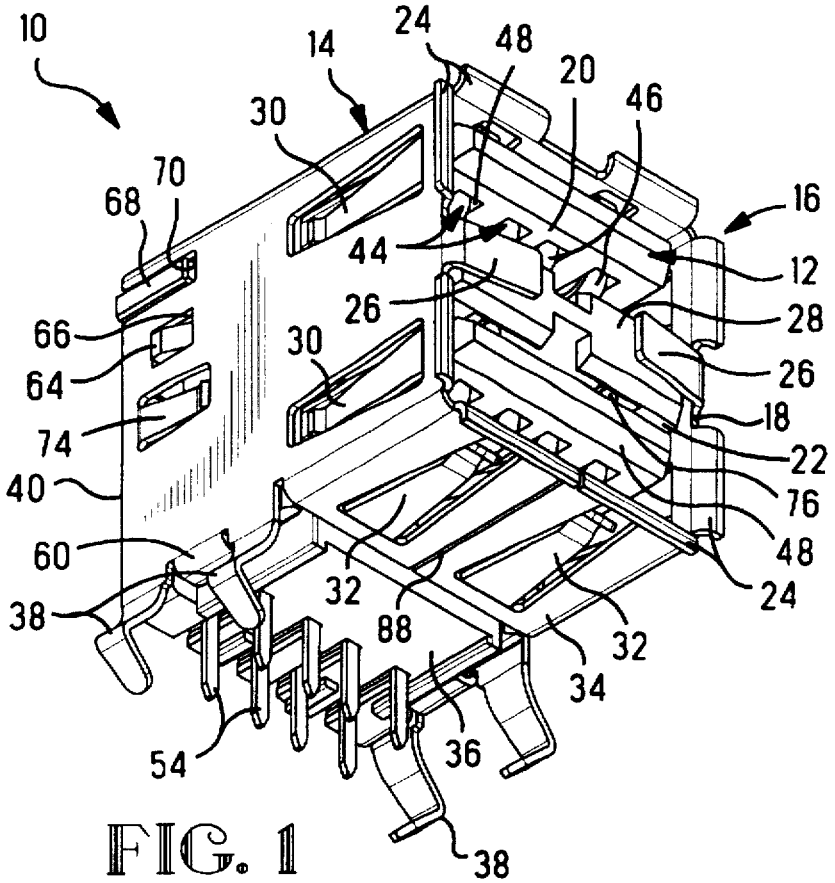
FIG. 1 is an isometric view of the connector of the present invention.
Figure 2:
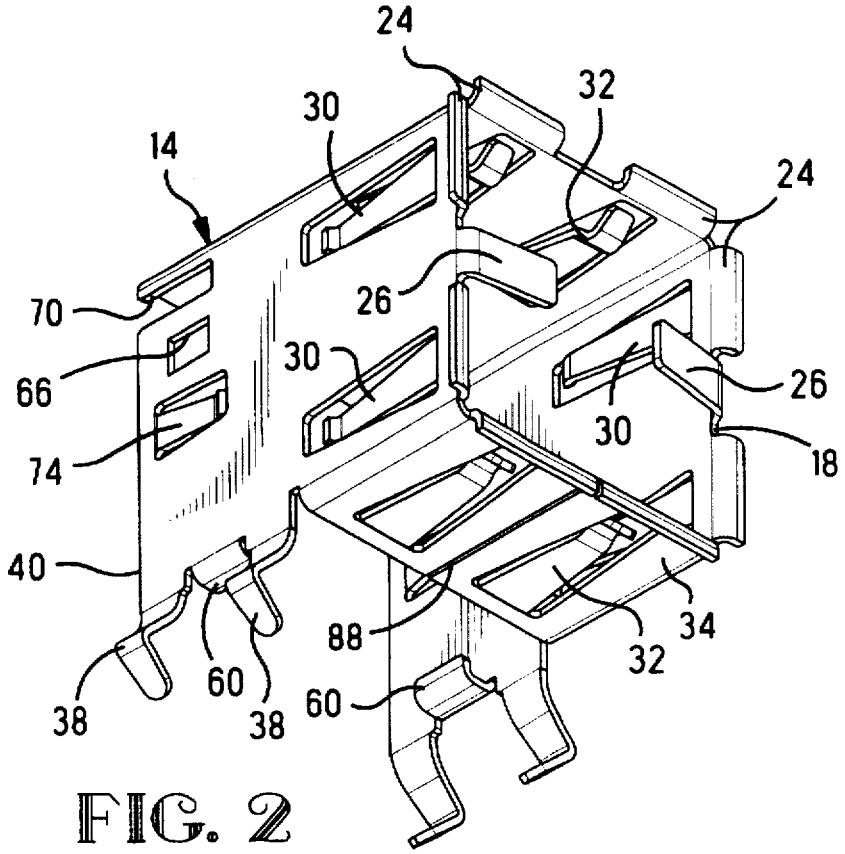
FIGS. 2 and 3 are isometric views of the shield member and the housing member, respectively, of the connector of FIG. 1.
Figure 3:
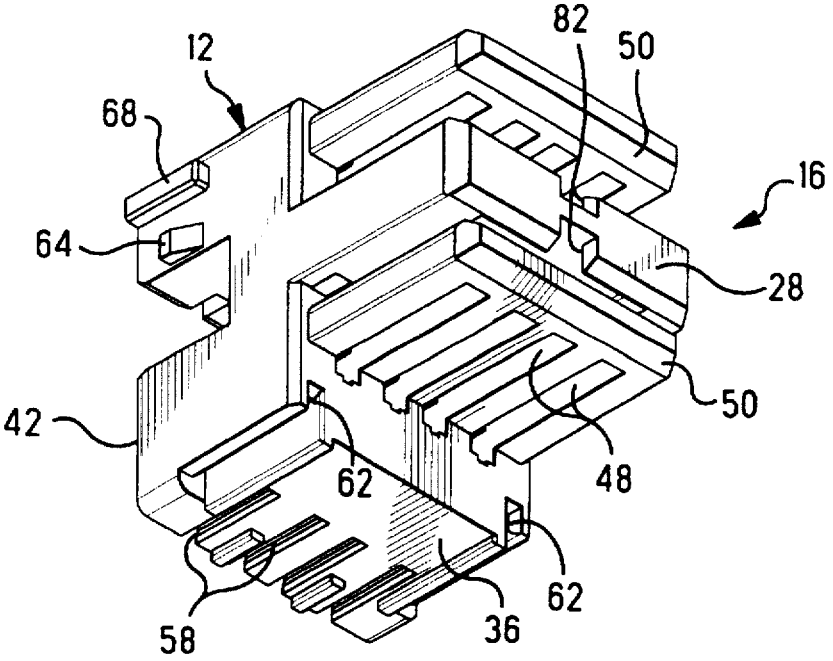

Connector 10 in FIGS. 1 to 4 includes an insulative housing 12 disposed within a conductive shell 14 that defines an EMI shield. Mating face 16 is exposed by forward end 18 of shell 14 for mating, and is shown to define two plug-receiving cavities 20,22. Shell 14 includes an array of short arcuate flanges 24 about the periphery of the mating face and is further shown to include a pair of elongate tabs 26 angled forwardly and toward each other from opposed sides of forward end 18, forwardly of and aligned with the central wall 28 of housing 12 between cavities 20,22. Also shown are spring arm contact sections 30 extending rearwardly and inwardly into the cavities for free ends thereof to engage the corresponding shields of the mating plugs (not shown); and retention arms 32 extending forwardly and into the cavities for free ends to seat within recesses in the side walls of the mating plugs to maintain the connectors in a mated condition.

Figure 4:
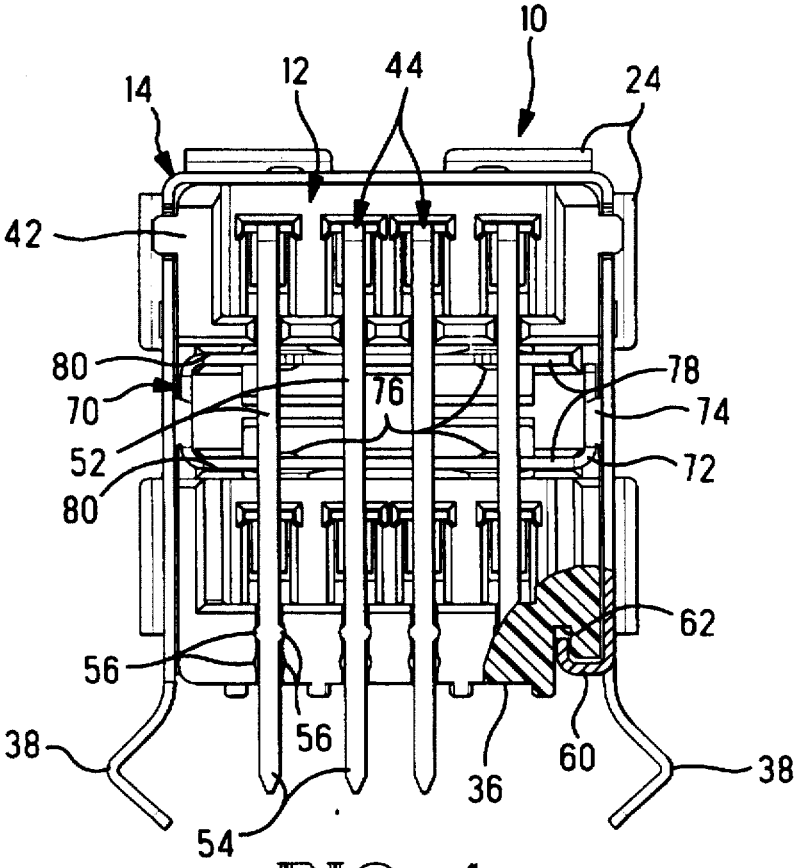
FIG. 4 is an elevation view of the rear face of the connector of FIG. 1.

Shell 14 also includes a bottom end 34 surrounding board-mounting face 36 of housing 12, and further includes an array of board-retention legs 38 adapted to cooperate with mounting holes of a circuit board (not shown) on which connector 10 is to be mounted. As seen in FIG. 4, rearward end 40 of shell 14 exposes rear face 42 of the connector housing.

A plurality of contacts 44 is disposed in connector 10 with first contact sections 46 disposed within channels 48 of support walls 50 of housing 12 that are positioned plug-receiving cavities 20,22. Right-angle legs 52 extend along rear fake 42 to second contact sections 54 depending below board-mounting face 36 for electrical connection with circuits of the circuit board. It can be seen that retention embossments 56 generate an interference fit of legs 52 within respective channels 58 extending inwardly from rear face 42 of housing 12 along board-mounting face 36.

Shell 14 is retained onto housing 12 by tabs 60 of along the bottom end 34 of shell 14 being seated within slots 62 of housing bottom 36 to prevent separation of the shell along the seam 88 (FIGS. 1 and 2) resulting from the stamping and forming of shell 14, latches 64 of housing 12 seating within recess 66 of shell 14, and stabilizing rib 68 of housing 12 disposed in recess 70 at shell rear end 40.

Figure 5:
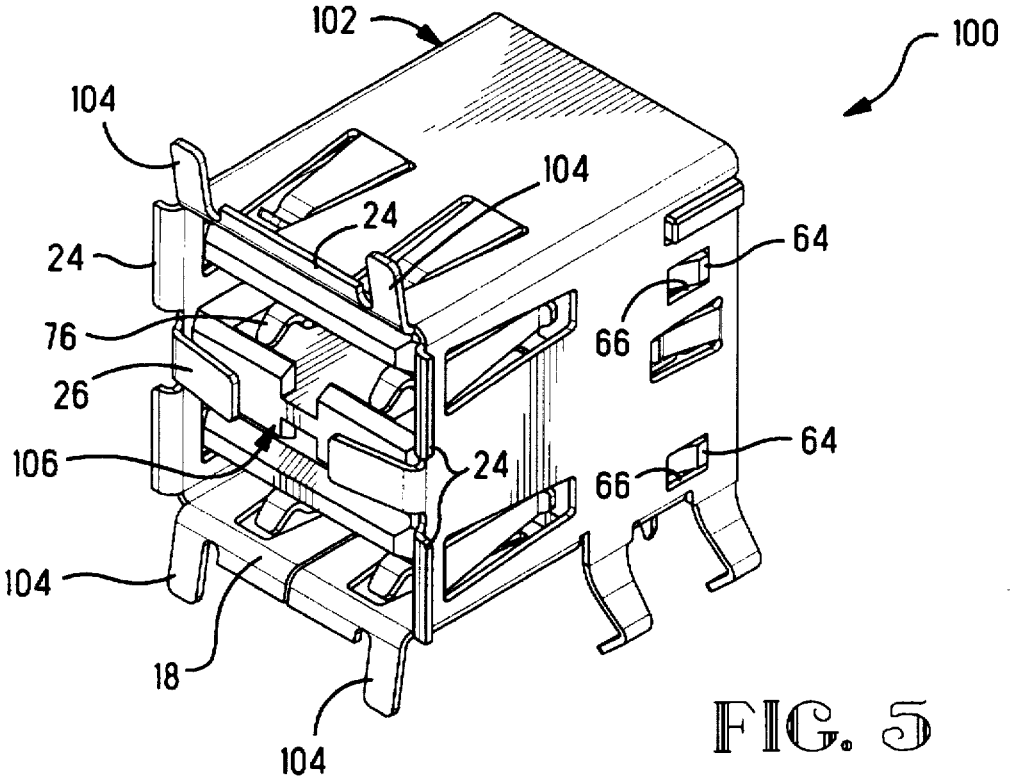
FIGS. 5 and 6 are isometric views of alternate embodiments of connectors of the invention, with FIG. 6 also showing a panel cutout with which the present invention is especially useful.

An inner conductive member or shell 72 is seen in FIG. 4 to be inserted into housing 12, electrically engaged by interconnect arms 74 of shell 14, and provide plug-retention arms 76 (leading ends of which are seen in FIGS. 1 and 5) similar to arms 32 of shell 14. Upper and lower plates 78 are inserted into slots 80 of housing 12 extending forwardly from rear face 42. Retention arms 76 extend forwardly from upper and lower plates 78 of the inner shell member and in recesses 82 of central wall 28, and are disposed on the opposite side of cavities 20,22 from arms 32 to engage opposite outer surfaces of mating plug connectors inserted into respective cavities 20,22. Inner shell member 70 is retained within connector 10 such as by rearwardly extending locking lances (not shown) on the upper and lower plates latching forwardly of stop surfaces defined within the body of housing 12 adjacent to slots 80 rearwardly of cavities 20,22.

Figure 6:
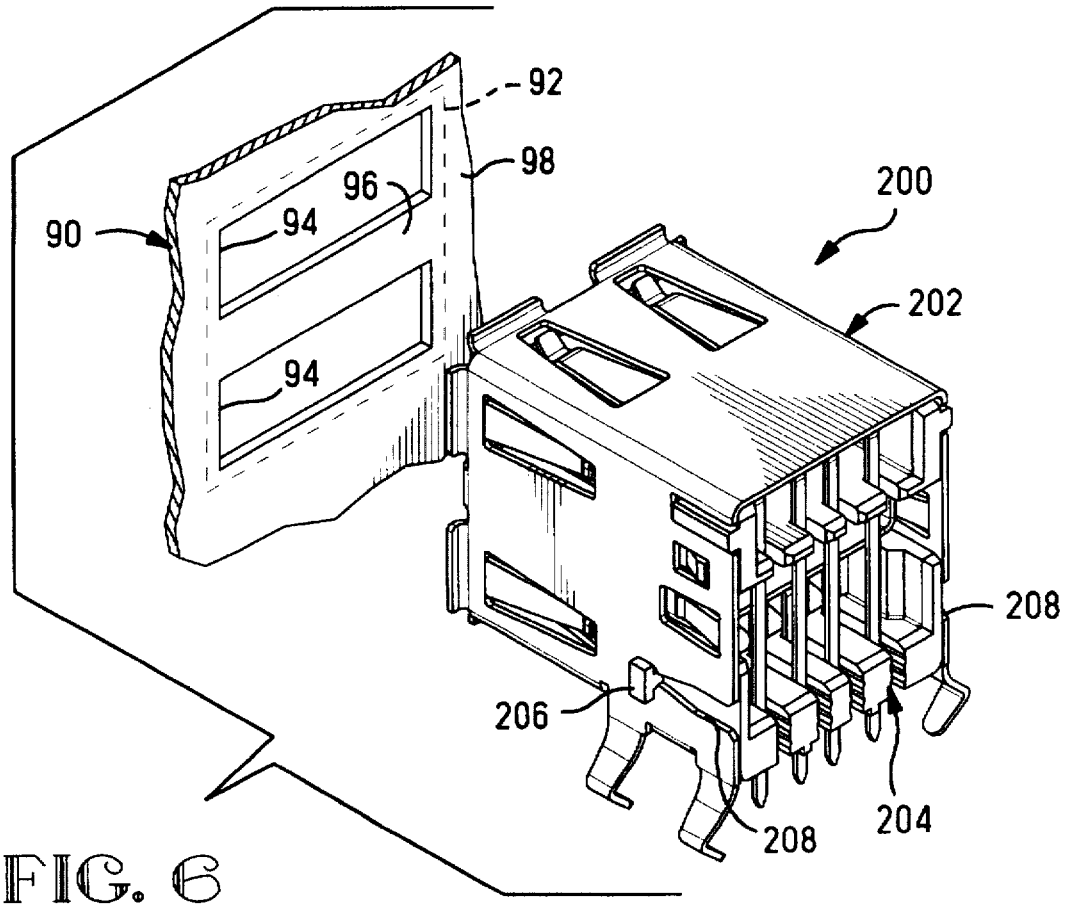

The pair of tabs 26 extend from opposed sides of forward end 18 of shell 14 toward each other and angled forwardly. Tabs 26 are associated with the panel cutout at which connector 10 is mounted in an electronic apparatus such as a computer. A panel 90 with a cutout 92 is shown in FIG. 6 and has cutout portions 94 separated by a strip 96 joining opposed sides of the periphery 98 of the cutout. Upon mounting of the connector at the cutout, plug-receiving cavities 20,22 are aligned with respective cutout portions 94, flanges 24 abut periphery 98 of cutout 90, and tabs 26 abut strip 96 to establish ground connections intermediate cutout portions 94 for enhanced shielding of the connector at the cutout. The tabs also assure an electrical grounding connection between shell 14 and panel 90 in the event that mounting of the circuit board to which connector 10 is mounted, within the apparatus adjacent cutout 90, results in an incremental spacing between flanges 24 and the panel. Even if flanges 24 are not in engagement with the panel, the flanges provide shielding to substantially close the gap between the cutout periphery and the shell and thus provide substantial shielding benefits, but it is preferable that actual ground engagement be attained between the shell and the panel.

Connector 100 in FIG. 5 illustrates another embodiment of the present invention in which shell 102 includes along forward end 18 thereof, pairs of upper and lower tabs 104 that will engage the panel upon the connector being mounted within an apparatus at the panel cutout. Upper and lower tabs 104 are angled to extend forwardly and outwardly from the connector mating face, similarly to tabs 26. Connector 100 also shows additional latches 64 of housing 106 seated within respective recesses 66, if desired.

In FIG. 6 is shown an additional embodiment of connector 200 having shell 202 enclosing housing 204, wherein a T-shaped projection 206 of housing 204 extends outwardly to be received into a slot 208 of shell 202. The constriction of the T-shaped projection seats forwardly of barbs of the slot, to retain the projection in position and securing the shell on the housing in a fixed position. T-shaped projection 206 assists in maintaining the side walls of shell 202 adjacent the side walls of housing 204, with respect to the open seam along the connector bottom resulting from the stamping and forming procedure for fabricating shell 202 (see FIGS. 1 and 2).

Figure 7:
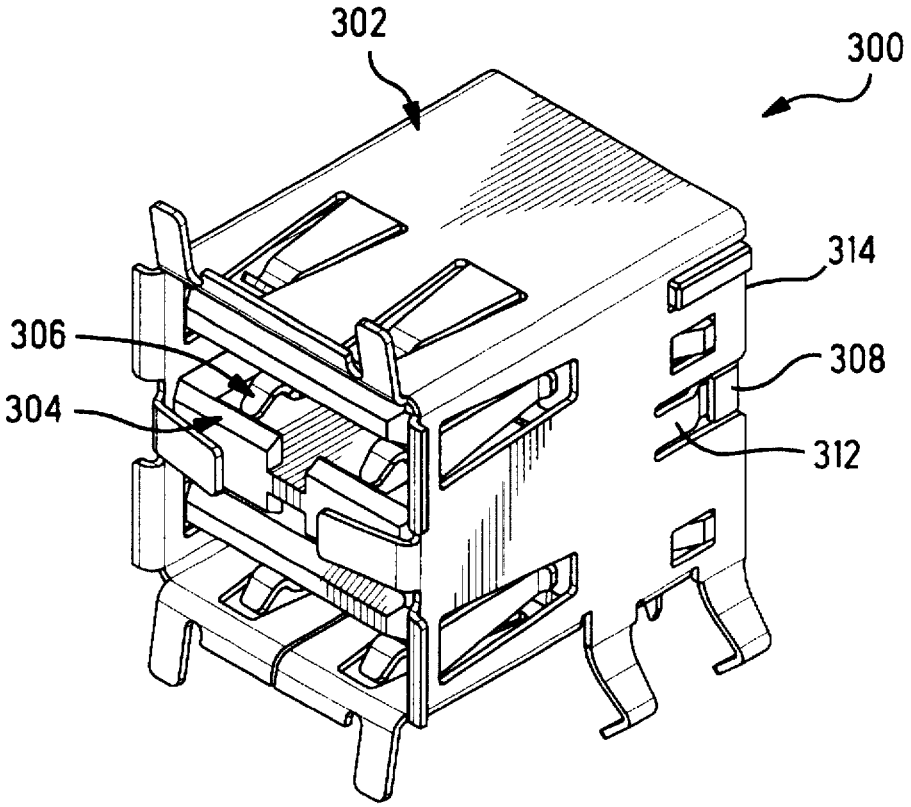
FIGS. 7 and 8 are an isometric and an enlarged part section view of an additional embodiment of the connector of the invention.
Figure 8:
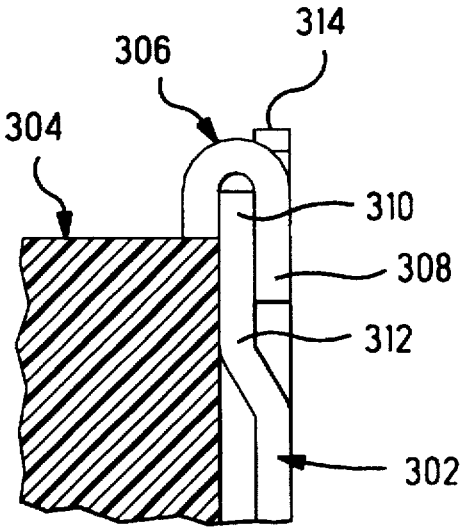

In FIGS. 7 and 8, connector embodiment 300 with shell 302 enclosing housing 304, an alternative manner is shown of establishing the electrical connection between the inner shell member 306 and shell 302. Tab 308 of the inner shell member is clinched around a free end 310 of arm 312 of shell 302 along rear end 314 of shell 302.

Other modifications and revisions may be made to the specific embodiments disclosed herein, that are within the spirit of the invention and the scope of the claims.

What is claimed is:

1. An electrical connector of the type mountable at a cutout of a conductive panel of an electronic apparatus, comprising:

an insulative housing having plug receiving cavities extending rearwardly from a mating face and aligned with the cutout for receipt of respective plug connectors thereinto for connector mating, with an array of contacts secured therein all within a metal shell for shielding thereof, with the metal shell having a forward end associated with the panel cutout and exposing plug receiving cavities of the housing in alignment with the cutout for mating with respective plug connectors, the metal shell having an array of panel-engaging flanges disposed about the forward end thereof to establish electrical connections with the periphery of the panel cutout, and the metal shell further including a pair of tabs at its forward end traversing the mating face angled forwardly and inwardly toward each other between the plug-receiving cavities, whereby shielding is enhanced by ground connections established by the metal shell with the conductive panel intermediate the plug-receiving cavities when the panel cutout comprises a pair of cutouts separated by an integral strip joining opposed sides of the panel cutout periphery.

2. The electrical connector as set forth in claim 1 wherein additional tabs extend outwardly and at an angle forwardly from the metal shell forward end to assuredly engage the panel cutout periphery.

3. An electrical arrangement of a shielded connector and a conductive panel of an apparatus having a cutout permitting connector mating at an input/output port of the apparatus, comprising:

said conductive panel having a cutout therethrough permitting insertion therethrough of plug connectors, and said connector having a metal shell surrounding an insulative housing, and the connector having separate plug-receiving cavities extending rearwardly from a mating face exposed forming with plug connectors at a forward end of the petal shell, the metal shell having panel-engaging flanges extending forwardly from the forward end thereof extending to the periphery of the conductive panel surrounding the cutout, the conductive panel defining a strip extending between opposed sides of the periphery separating portions of the cutout with which the plug-receiving cavities of the connector are aligned for mating, and the metal shell including a pair of tabs at its forward end traversing the mating face, each extending toward the other and angled forwardly from the mating face between the cutout portions of the conductive panel to define ground connections therewith, for enhanced shielding of the connector at the cutout.

4. The electrical arrangement as set forth in claim 3 wherein additional tabs extend outwardly and at an angle forwardly from the metal shell forward end to assuredly engage the panel cutout periphery.

* * * * *